US006508600B1

(12) United States Patent
Nonaka

(10) Patent No.: US 6,508,600 B1
(45) Date of Patent: Jan. 21, 2003

(54) PRINTER

(75) Inventor: Tadashi Nonaka, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 0 days.

(21) Appl. No.: 09/698,205

(22) Filed: Oct. 30, 2000

(30) Foreign Application Priority Data

Oct. 29, 1999 (JP) ..... 11-308753

(51) Int. Cl.[7] ..... B41J 15/18; B41J 11/44; B41J 29/38; B41F 13/56

(52) U.S. Cl. ..... 400/621; 400/54; 400/593; 101/227

(58) Field of Search ..... 400/621, 690, 400/54, 593; 101/227

(56) References Cited

U.S. PATENT DOCUMENTS 5,749,277 A 5/1998 Walker
5,993,093 A * 11/1999 Schoennauer et al. ..... 400/621
6,145,423 A * 11/2000 Boreali et al. ..... 83/145
6,155,731 A * 12/2000 Bertalan et al. ..... 400/621

FOREIGN PATENT DOCUMENTS

JP 2000-52291 2/2000 ..... B26D/1/06
WO 98/17475 4/1998

* cited by examiner

*Primary Examiner*—Andrew H. Hirshfeld
*Assistant Examiner*—Marvin P. Crenshaw
(74) *Attorney, Agent, or Firm*—Sughrue Mion, PLLC

(57) ABSTRACT

In a printer, a body cover is reclosably attached to a printer body (10). A fixed blade (14) and a movable blade (42) are attached to the printer body (10) and the body cover (20), respectively. The movable blade (42) is superposed on the fixed blade (14) when moved toward the fixed blade. Thus, a paper jam can quickly be cleared. Moreover, paper can be cut well.

4 Claims, 9 Drawing Sheets

PRINTER

BACKGROUND OF THE INVENTION

1. Field of the Invention

The present invention generally relates to a small printer used with, for example, an electronic cash register of a POS (Point Of Sale) system, and more particularly, to techniques of enabling the -printer to easily and quickly clearing a paper jam occurred in a separate type paper cutter mechanism that comprises a printer-body-side part and a movable-cover-side part, which are separated from each other.

2. Description of the Related Art

Generally, the printer of the electronic cash register is configured so that paper is fed out of a roll thereof and then data is printed on the paper on a paper conveying path by a thermal head, and that subsequently, the paper is cut off and discharged as a receipt. In recent years, a printer of the type, in which a cover for opening and closing a paper accommodating portion is rotatably attached to a printer body having a printing mechanism and the paper accommodating portion, has been brought into the mainstream of the printer of the electronic cash register. An example of a paper cutter mechanism provided in the printer of such a type is a separate press-cutting type paper cutter mechanism, in which each of a fixed blade and a movable blade is constituted by a plate-like blade and in which the fixed blade is provided in a cover side and the movable blade is provided in a printer body. This separate type cutter mechanism is such that the fixed blade faces the movable blade across the paper conveying path in a normal state, in which the cover is closed, that the movable blade is caused to perform reciprocating motion between the printer body and the cover, at which the fixed blade is placed, and that both the blades cut the paper in cooperation with each other by superposing the movable blade on the fixed blade when the movable blade moves to the cover. In this case, it is preferable for cutting the paper smoothly that the movable blade is superposed on a downstream side of the paper conveying path with respect to the fixed blade. Furthermore, generally, other press-cutting cutters (for instance, a paper cutter for use in an office) are configured in such a manner.

In the case of the separate type cutter mechanism, the movable blade is provided in the printer body. Thus, naturally, a drive mechanism (such as a motor or a reduction gear) for driving this movable blade is also provided in the printer body. Therefore, such a separate type cutter mechanism is advantageous in preventing occurrences of drawbacks, which would be caused in the case of providing the movable blade in the cover, that is, drawbacks that the weight of the cover is increased, and that wiring becomes complex. Meanwhile, in the cutter mechanism adapted to cut paper by using a plate-like fixed blade and a plate-like movable blade, a paper jam, by which paper is put between the two blades, may occur, and the movable blade may be locked by being simultaneously superposed onto the fixed blade. Although a paper jam can be cleared by opening the cover, the movable blade superposed onto the fixed blade prevents the cover from opening. Thus, the cover cannot be opened. Therefore, to solve a paper jam, the printer is forced to return the movable blade to a home position during the paper is put between both the blades. To that end, a user is forced to perform, for instance, a troublesome operation of manually rotating a pinion of a drive motor for the movable blade and a reduction gear in a direction, in which the movable blade is moved back to the printer body.

SUMMARY OF THE INVENTION

The present invention has been made to solve the above problem, and therefore an object of the present invention is to provide a printer which can easily and quickly clear a paper jam occurring in a separate type cutter mechanism.

According to the present invention, there is provided a printer that comprises a printer body, which has a paper accommodating portion, a paper conveying path, and a printing mechanism for printing data on paper conveyed on the paper conveying path, a body cover rotatably and disengageably attached to the printer body in such a manner as to close the paper accommodating portion, and a paper cutter mechanism for cutting paper on the paper conveying path at the downstream side of the printing mechanism. In this printer, the paper cutter mechanism comprises a fixed blade provided in the printer body, a movable blade provided on the body cover so as to face the fixed blade across the paper conveying path when the body cover is closed, and to be able to perform reciprocating motions with respect to the fixed blade, and to cut paper in cooperation with the fixed blade by being superposed on the fixed blade when moved toward the fixed blade, and drive means for causing the movable blade to perform reciprocating motions.

According to the printer of the aforementioned configuration, paper is accommodated in the paper accommodating portion by opening the body cover. Thereafter, when the body cover is closed and engaged with the printer body, the printer is put into a ready state. During the printer is working, a fundamental operation is performed as follows. That is, the paper accommodated in the paper accommodating portion is conveyed on the paper conveying path. Halfway through the conveyance, the printing mechanism prints data on the paper. Upon completion of printing, the movable blade moves toward the fixed blade side. Then, the printing paper is cut by using both the blades. Upon completion of cutting, the movable blade is moved back and returned to the initial position thereof.

Meanwhile, according to the present invention, in the case that a paper jam, by which the paper is put between both the blades, occurs when the paper is cut (or when the movable blade moves toward or back from the fixed blade), the paper jam can be cleared by opening the body cover having the movable blade. That is, the movable blade is superposed on the fixed blade when moved toward the fixed blade. This prevents the movable blade from abutting against the fixed blade when the body cover is opened, and from hindering an opening operation of the body cover. Consequently, a paper jam clearing operation can quickly be performed by opening the body cover and removing a jammed part of the paper.

Further, the paper having passed through the paper cutter mechanism is not under tension but is in a free state. In contrast, the paper placed on the upstream portion of the paper cutter mechanism is under tension caused by the printing mechanism or the subsequent portion of the paper. Incidentally, the paper is fixed under tension at the fixed blade side by superposing the movable blade at the downstream of the fixed blade. Conversely, the paper is in a free state at the movable blade side. Thus, the paper is cut well. Consequently, there is no fear that a cut sheet is damaged. In contrast with this, in the case of employing the configuration in which the movable blade is superposed at the upstream of the fixed blade, the paper held under tension may interfere with the movable blade. Further, the paper on a fixed-blade side portion of the path may be insecurely fixed thereto. Thus, the movement of the movable blade may cause the fixed-blade-side paper to move. Consequently, the cutter mechanism employing this configuration is relatively inferior in the degree how well is cuts the paper. Moreover, the movable blade may damage and streak the paper.

Furthermore, preferably, an embodiment of the printer according to the present invention, a fixe-blade cover is provided in the printer body in such a manner as to face the rotating end portion of the body cover, which is in a closed state, and to cover the fixed blade when the body cover is in an opened state. This embodiment prevents the fixed blade from being touched in a state in which the body cover is opened. This is an effective safety measure, especially, when the paper is accommodated in the paper accommodating portion. Moreover, in this embodiment, preferably, this fixed-blade cover does not interfere with the body cover when the body cover is engaged with or disengaged therefrom. To that end, it is sufficient that the fixed blade is enabled to retreat from the rotating end portion of the body cover in such a way as to allow an disengaging motion of the body cover with respect to the printer body.

Additionally, preferably, an embodiment of the printer of the present invention includes a locking mechanism for locking the fixed-blade cover at a position, at which the fixed-blade cover covers the fixed blade, and at a predetermined position that is opposite to the rotating end portion of the body cover. Consequently, even in the case that the fixed-blade cover is touched when the body cover is opened, the fixed-blade cover does not move. Thus, safety is ensured. On the other hand, in the case that the printer is in an operational state in which the body cover is closed, the immobile state of the fixed-blade cover is maintained.

Further, preferably, an embodiment of the printer of the present invention includes cover opening means for enabling the body cover to open by canceling an engaged state, in which the body cover engages with the printer body, is provided in the printer body. Moreover, the printer is adapted so that when the cover opening means is operated, the fixed blade operates together therewith and retreats from the rotating end portion of the body cover. According to this embodiment, when the cover opening means is operated, the fixed blade operates together therewith and retreats from the rotating end portion of the body cover. Furthermore, the engaged state, in which the body cover engages with the printer body, of the body cover is canceled. Thus, the body cover can smoothly be opened by a single operation. Preferably, the cover opening means is, for instance, a lever to be pushed in a direction, in which the fixed-blade cover retreats.

DETAILED DESCRIPTION OF THE PREFERRED EMBODIMENTS

Hereinafter, an embodiment of the present invention will be described with reference to the accompanying drawings.

A. Configuration of the Printer

Figure 1:
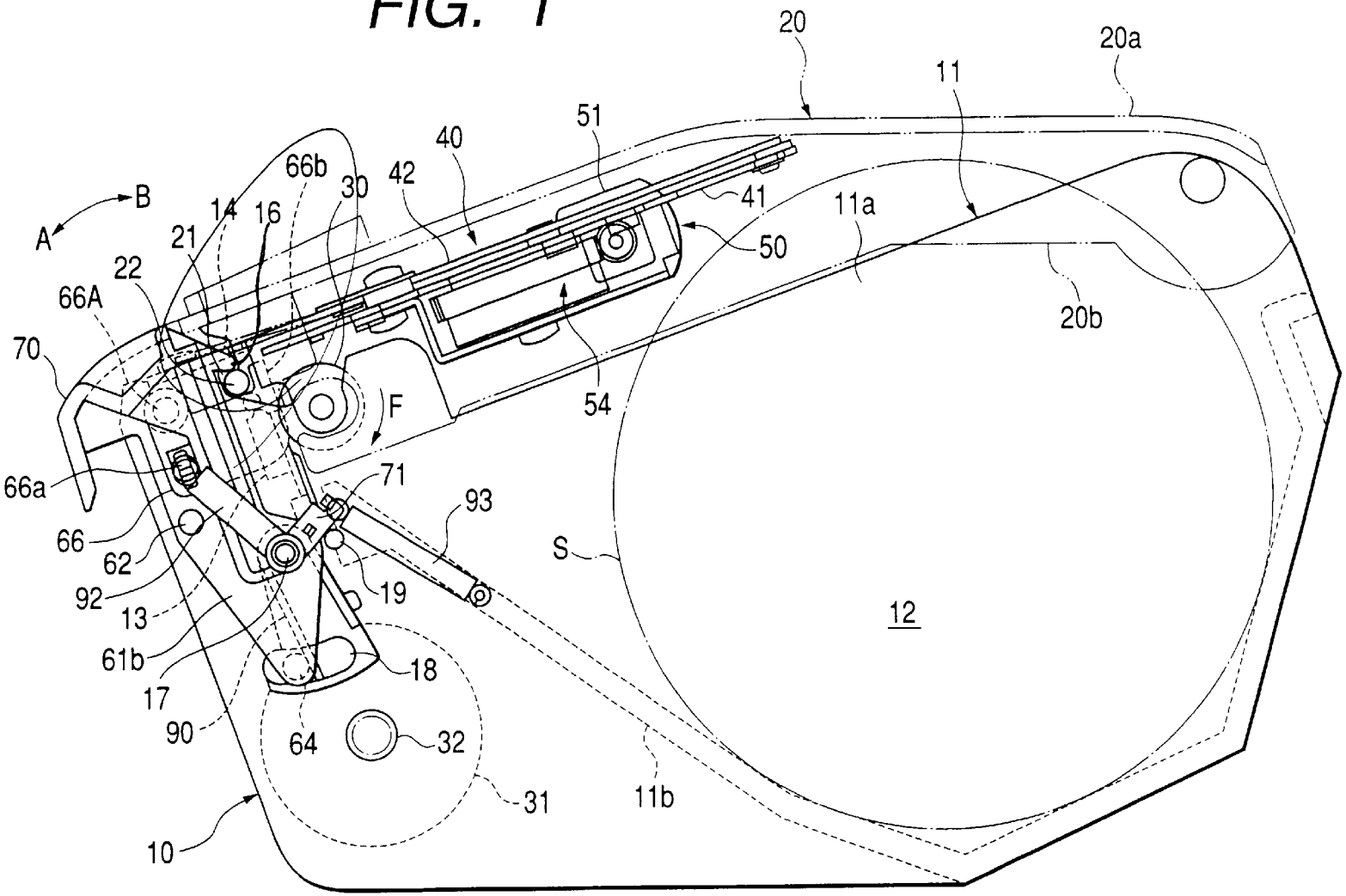
FIG. 1 is a right-hand side view illustrating a state, in which a body cover is closed, of a printer that is an embodiment of the present invention.
Figure 2:
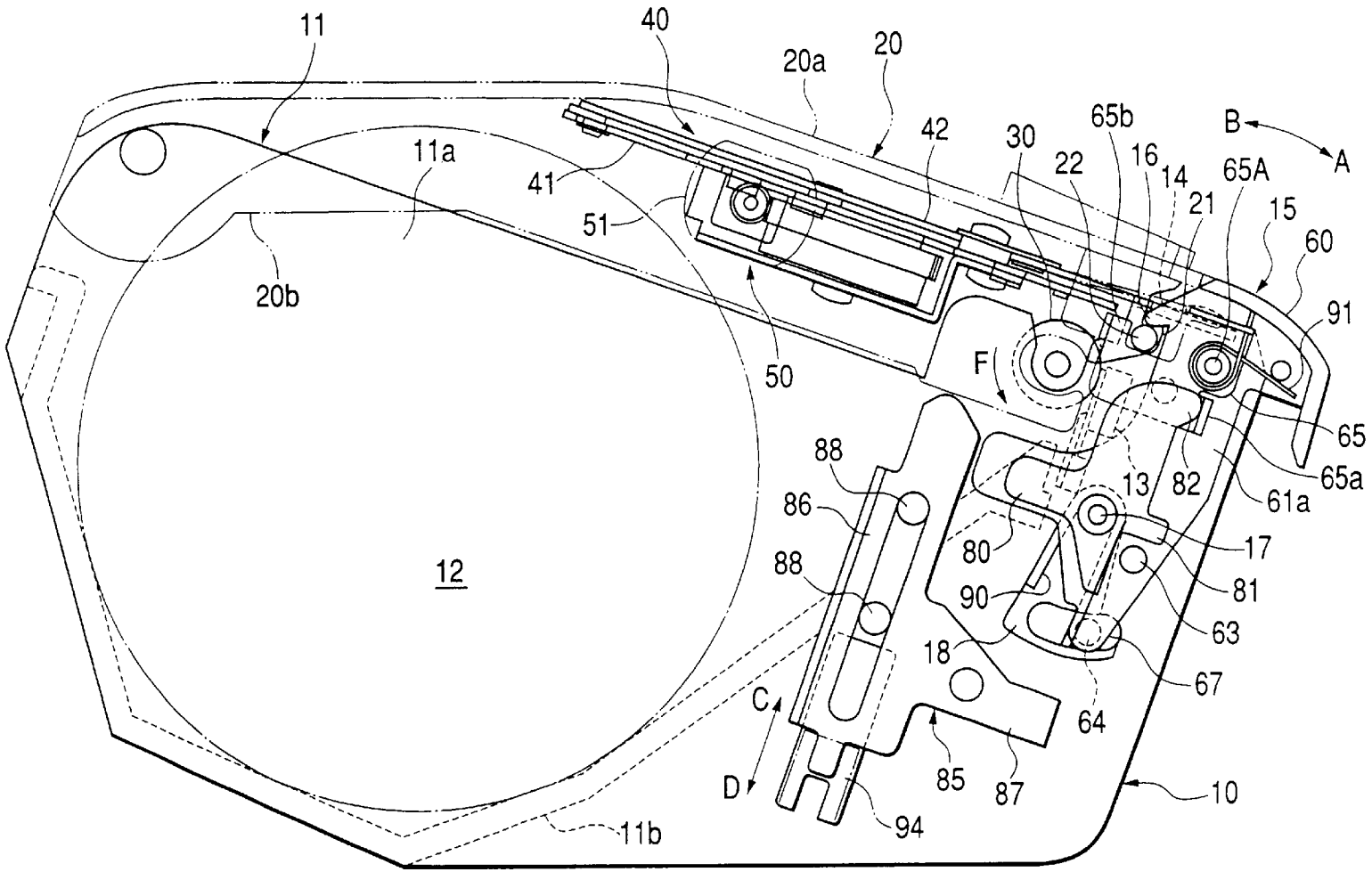
FIG. 2 is a left-hand side view of the printer.
Figure 3:
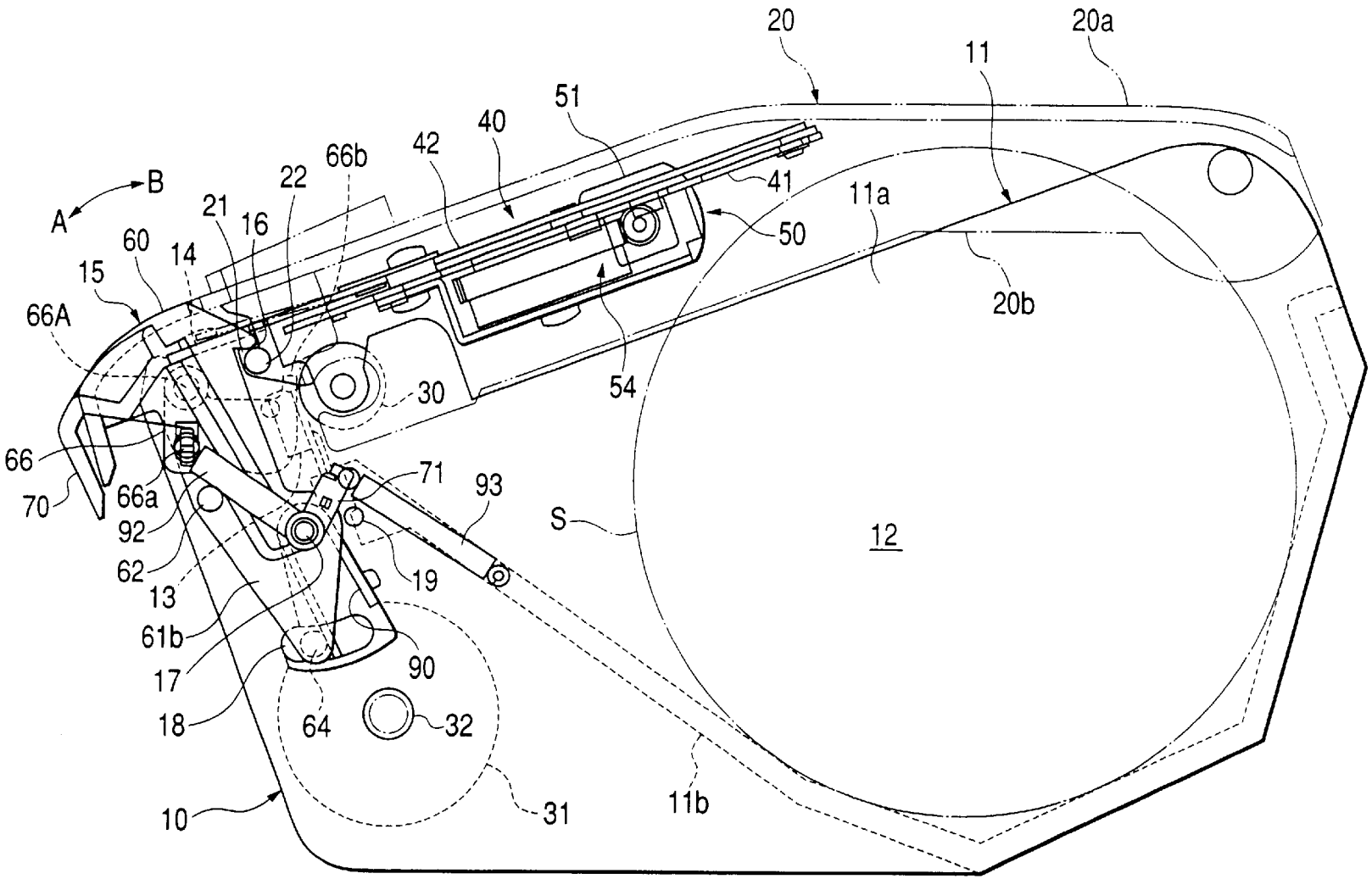
FIG. 3 is a right-hand side view illustrating an operation of opening the body cover of the printer that is the embodiment of the present invention.
Figure 4:
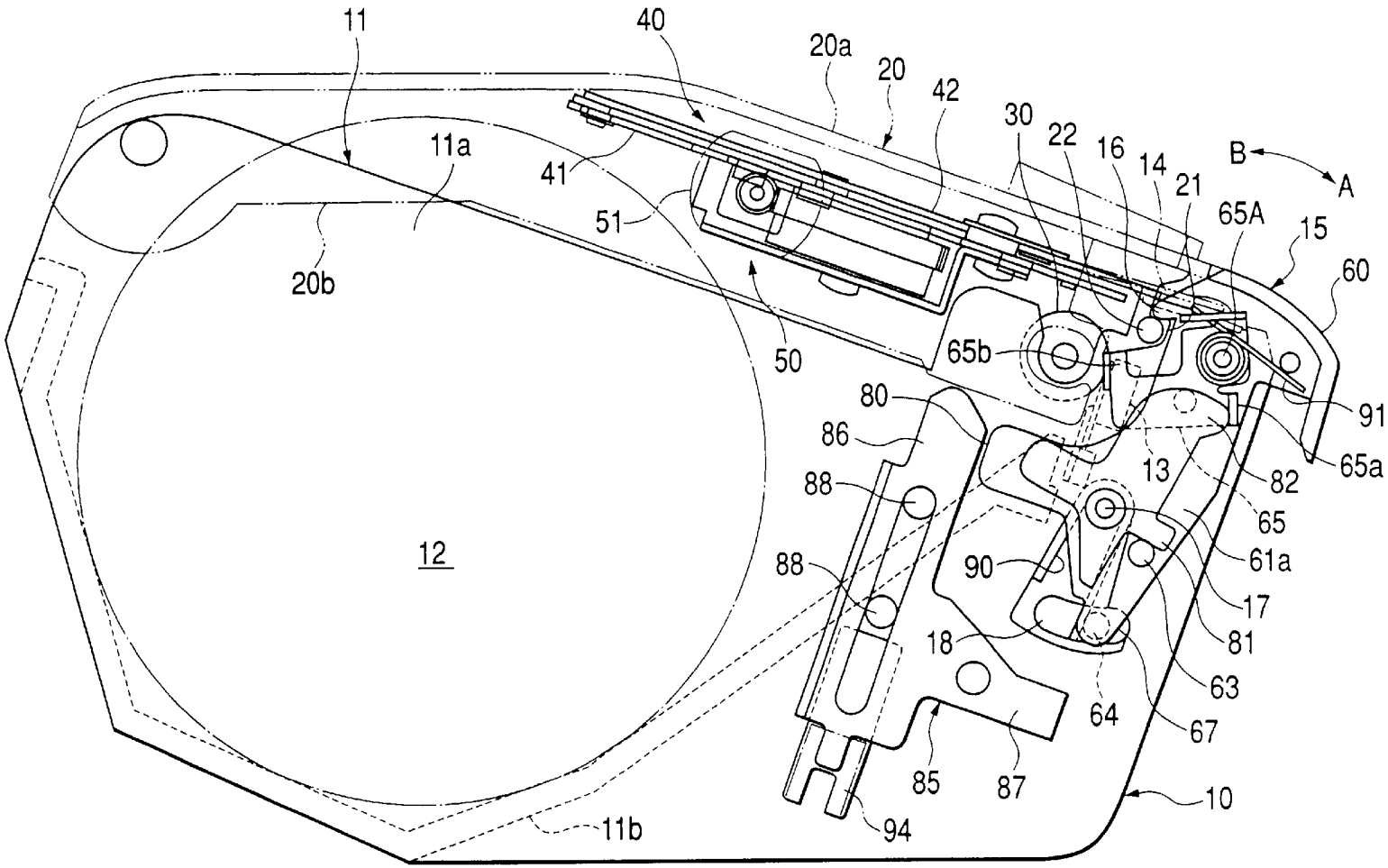
FIG. 4 is a left-side view of the printer shown in FIG. 3.
Figure 5:
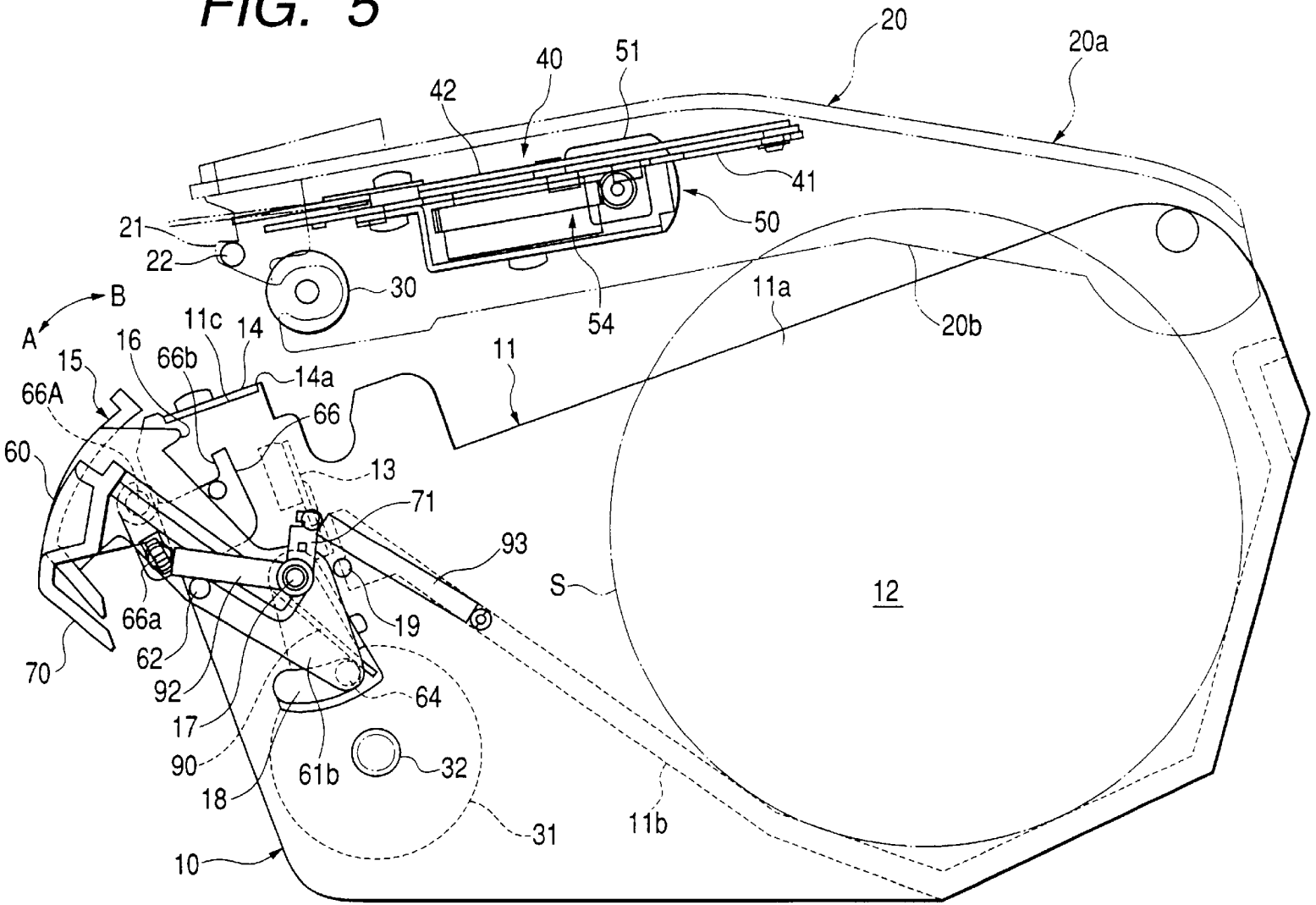
FIG. 5 is a right-hand side view illustrating a state, in which the body cover is opened, of the printer that is the embodiment of the present invention.
Figure 6:
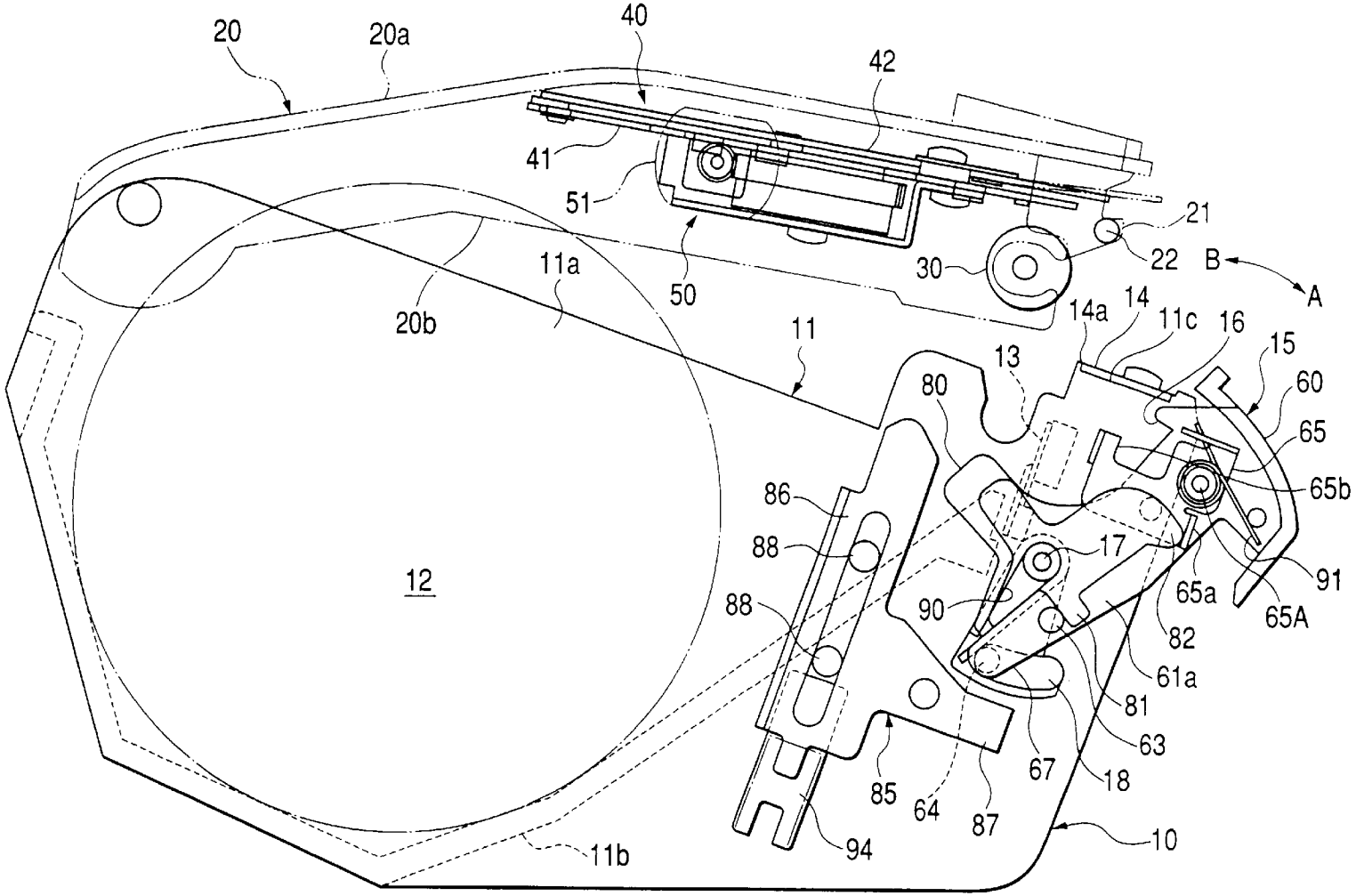
FIG. 6 is a left-side view of the printer shown in FIG. 5.
Figure 7:
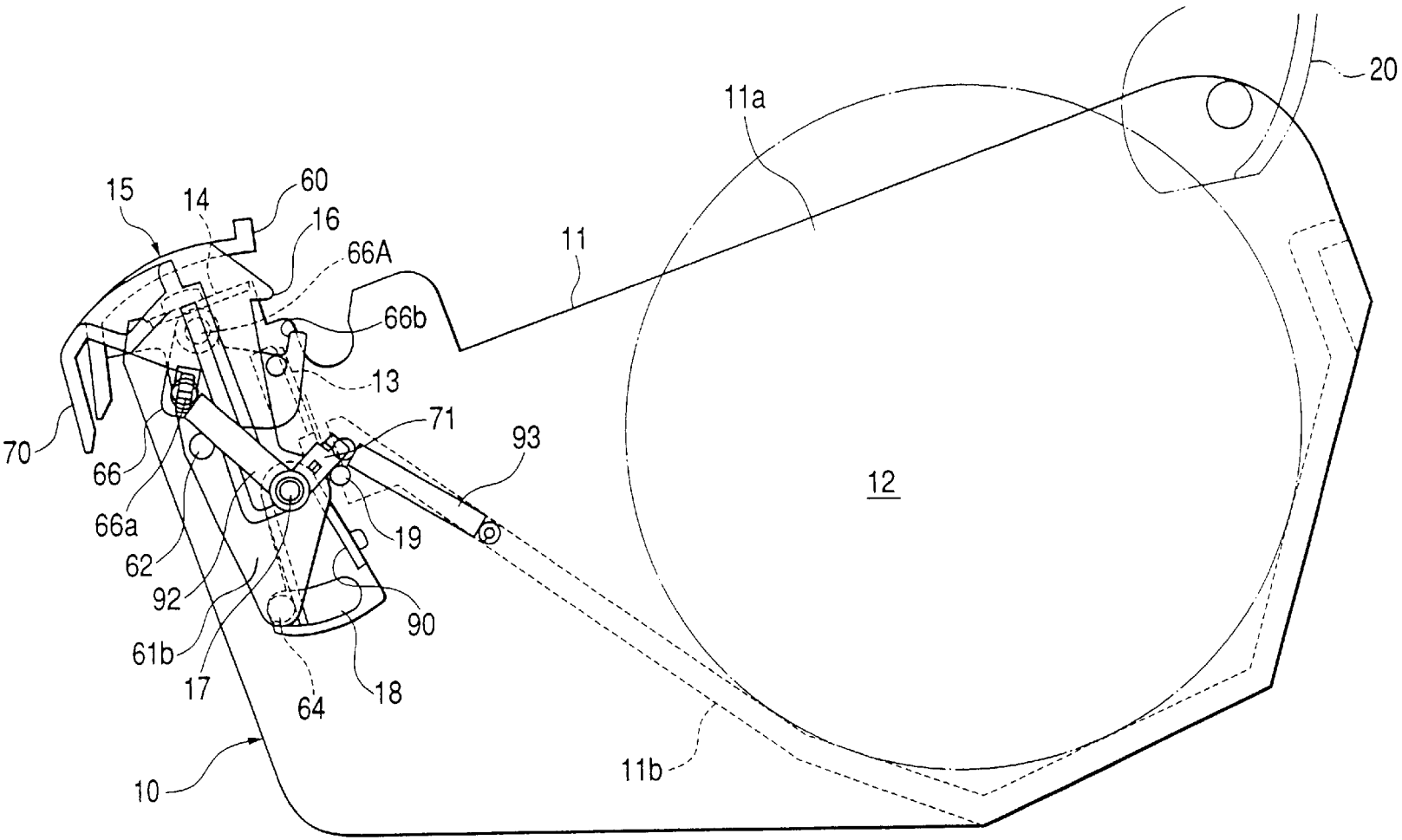
FIG. 7 is a right-hand side view illustrating a state, in which the body cover is opened and a fixed-blade cover covers a fixed blade, of the printer that is the embodiment of the present invention.
Figure 8:
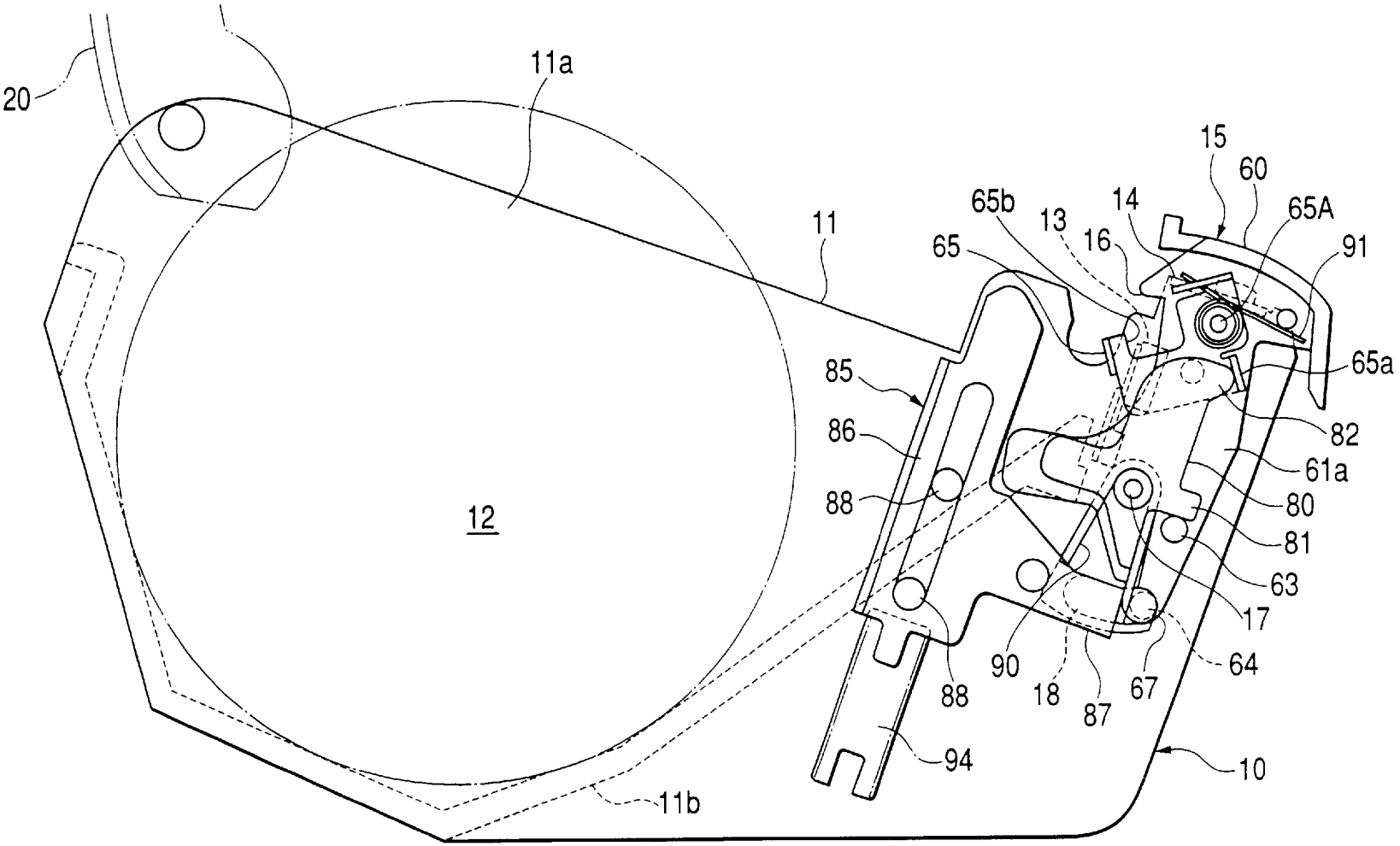
FIG. 8 is a left-side view of the printer shown in FIG. 7.

FIGS. 1 and 2 are a right-hand side view and a left-hand side view of the entire printer, which is a first embodiment of the present invention, respectively. This printer is a small printer for use with an electronic cash register, and has a printer body 10 and a body cover 20. FIGS. 1 and 2 illustrate a state in which the body cover 20 is closed. FIGS. 3, 5, and 7 are right-hand side views illustrating the process of an operation of gradually opening the body cover 20, in this order. FIGS. 4, 6, and 8 are left-hand side views respectively corresponding to FIGS. 3, 5, and 7. A paper cutter mechanism provided in the printer is of the separate type, in which a fixed blade is disposed in the printer body 10, and in which a movable blade is placed in the body cover 20. In the printer according to this embodiment, operations of printing data on paper, conveying paper, and moving the movable blade are controlled by a printer control portion (not shown) constituted by a microcomputer.

The printer body 10 is mainly composed of a box-like frame 11 having lateral side plates 11*a*. A paper accommodating portion 12 constituted by the side plates 11*a* and a bottom portion plate 11*b* is provided in the frame 11. Thermal paper S stored in a roll-like form is accommodated in this paper accommodating portion 12. The paper S is accommodated so that the leading end portion thereof is drawn from the bottom side to the front side (that is, the left-hand side, as viewed in FIGS. 1, 3, 5, and 7, and the right-hand side, as viewed in FIGS. 2, 4, 6, and 8). The body cover 20 has an end portion hinge-connected to the upper rear portion of the frame 11, and is rotatably attached to the frame 11 in such a way as to close the paper accommodating portion 12.

The front end portion of the frame 11 is provided with a thermal head 13 extending in lateral directions (that is, in FIGS. 1 to 8, in directions that are normal to both sides of the paper on which the drawings are drawn). A plate-like fixed blade 14 is provided above and in parallel with the thermal head 13. As illustrated in FIGS. 5 and 6, this fixed blade 14 is fixed to a plate portion 11*c* formed at the front end portion of the frame 11 in such a manner as to be slightly frontwardly and downwardly inclined. The rear edge of this fixed blade 14 constitutes a blade portion 14*a*. A fixed-blade cover 15 for covering over the fixed blade 14 is provided in the frame 11 in such a manner as to face the front end portion (or rotating end portion) of the body cover 20, which is in the closed state.

The body cover 20 is constructed by integrally forming a top plate 20*a*, which covers over the paper accommodating portion 12 of the frame 11, and lateral side plates 20*b*, which extend vertically downwardly from the top plate 20*a*, with one another. Each of the side plates 20*b* is hinge-connected to the frame 11. A hook 21 is formed at the front end portion of each of the lateral side plates 20*b* of the body cover 20. The body cover 20 maintains the closed state thereof by engaging each of the hooks 21 with a hook 16 formed on the fixed-blade cover 15.

A platen roller 30 laterally extending is rotatably supported by the front end portions of the side plates 20*b* of the body cover 20. Both ends of the shaft of this platen roller 30 outwardly project from the side plates 20*b*. At the right-hand projecting end thereof, a driven gear (not shown) is coaxially fixed. As illustrated in FIG. 1, a platen drive motor 31 is fixed inside the right-hand side plate 11*a* of the frame 11. The drive shaft of this motor 31 penetrates the side plates 11*a*. A pinion 32 is attached to each of the projected ends of this drive shaft. Further, an intermediate gear train (not shown), connected to the pinion 32, for transmitting the driving force of the platen drive motor 31 to the platen roller 30 is disposed outside the right-hand side plate 11*a*. Furthermore, when the body cover 20 is closed, the platen roller 30 is pressed into contact with the thermal head 13 by appropriate pressure. Moreover, the driven gear meshes wit h the most downstream gear of the intermediate train. In this embodiment, the printing mechanism consists of the thermal head 13 and the platen roller 30.

Figure 9:
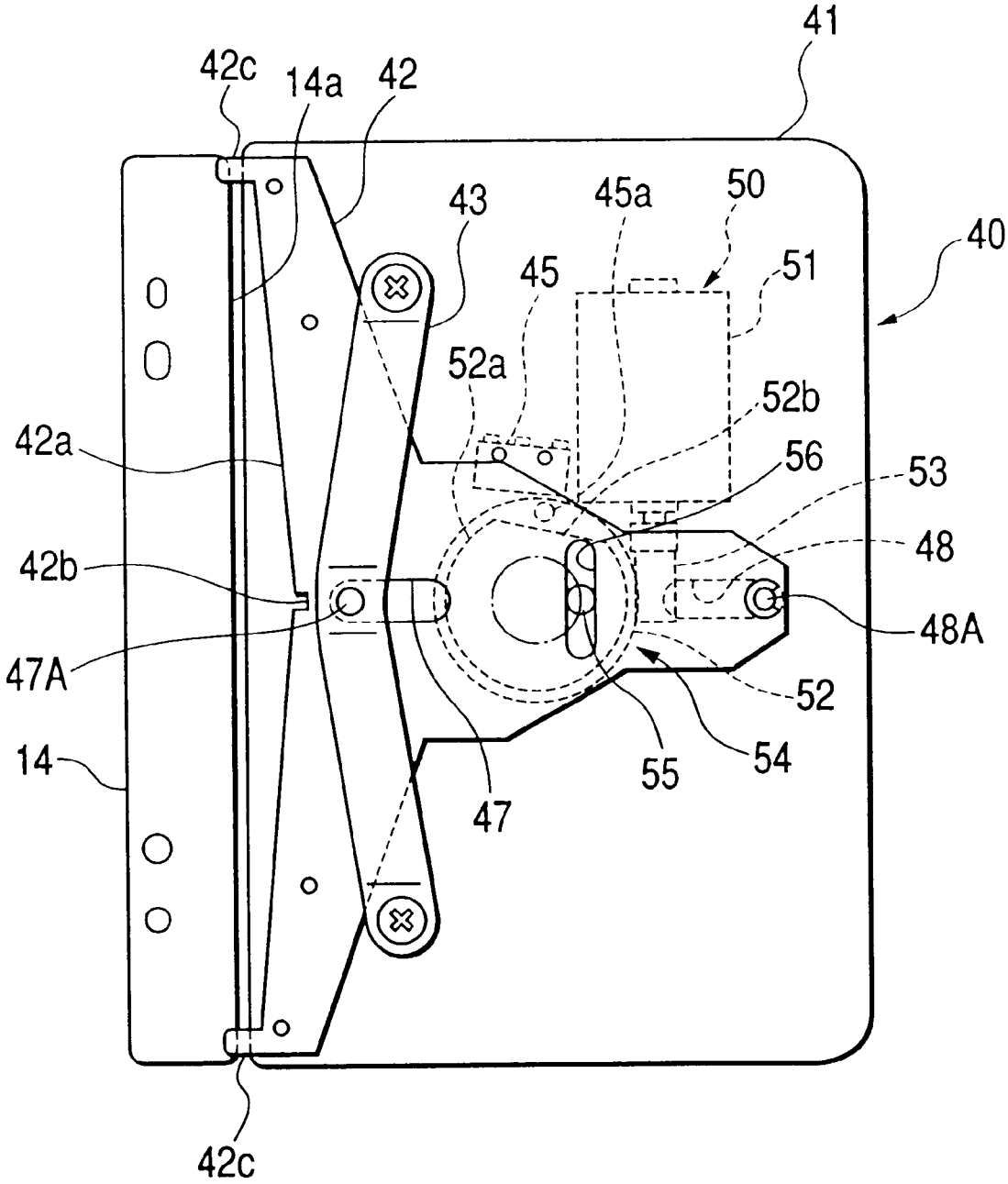
FIG. 9 is a plan view illustrating a movable-blade unit provided in the printer that is the embodiment of the present invention.

A movable blade unit 40 for cutting the paper in cooperation with the fixed blade 14 is provided on the back surface of the body cover 20. As illustrated in FIG. 91 this movable blade unit 40 consists of a support plate 41, a nearly-T-shaped movable blade 42 incorporated into the support plate 41 in such a manner as to be able to perform a back-and-forth reciprocating motion (in lateral directions, as viewed in FIG. 9), a plate spring 43 for providing a cutting pressure to the movable blade 42, a drive mechanism 50 for causing the movable blade 42 to perform reciprocating motions, and a home position sensor 45 for detecting whether or not the movable blade 42 is at the home position. The support plate 41, the movable blade 42, and the plate spring 43 are stacked in this order. The support plate 41 is fixed to the body cover 20 in a state in which the movable blade 42 and the plate spring 43 are put between the support plate 41 and the body cover 20. Incidentally, FIG. 9 illustrates a state in which the movable blade 42 is at the home position that is a most retreated position thereof from the fixed blade 14.

The movable blade 42 has a front end edge constituting the blade portion 42*a*, which is shaped like a late rally symmetrical character "V" and forwardly protruded so that the degree of protrusion increases toward both ends away from the central part thereof, so as to realize smooth paper cutting. Further, a concave portion 42*b* is formed in the central part of the blade portion 42*a* as a recess for leaving an uncut part of the paper S and bringing this uncut part into a state in which this part is connected to the subsequent part of the paper S. In the case of completely cutting off the printed part of the paper S, it is unnecessary to form this concave portion 42*b*. A guide piece 42*c*, which gets on the fixed blade even when the movable blade 42 is at the home position, is formed at each of both front end portions of the movable blade 42 in such a manner as to forwardly project therefrom. These guide pieces 42*c* preliminarily get on the fixed blade 14, so that the blade portion 42*a* of the movable blade 42 is smoothly superposed on the fixed blade 14. An elongated hole extending in the front and rear direction is formed just behind the concave portion 42*b*. Furthermore, at the rear end portion thereof, a first guide pin 48A protruding toward the support plate 41 is provided. Moreover, a second guide pin 47A provided in such a manner as to project therefrom is inserted into the elongated hole 47. The first guide pin 48A is inserted into an elongated hole 48, which is formed in the support plate 41 and extends in the front and rear directions. The back-and-forth reciprocating motions of the movable blade 42 is guided by the combination of the elongated hole 47, the guide pin 47A, the elongated hole 48, and the guide pin 48A.

The plate spring 43 is operative to push the movable blade 42 against the support plate 41 so that the blade portion 42*a* of the movable blade 42 is superposed on the fixed blade 14 by an appropriate pressure. Both end portions of the plate spring 43, which traverses a slightly back of the blade portion 42*a*, are fixed to the support plate 41. Incidentally, the resilient force of the plate spring 43 does not restrict the reciprocating motion of the movable blade 42.

The drive mechanism 50 is composed of the movable drive motor 51, which is controlled by the printer control portion, and a worm gear consisting of a worm wheel 52 and a worm 53. The worm wheel 52 is placed under the support plate 41. The worm 53 provided on the drive shaft of the movable drive motor meshes with this worm wheel 52. A cam pin 55 protruding toward the movable blade 42 is formed at a predetermined eccentric part of the worm wheel 52. This cam pin 55 is inserted into an elongated hole 56, which is formed on the movable blade 42 and laterally extends.

According to the aforementioned drive mechanism 50, when the movable blade drive motor 51 operates and the worm wheel 52 is rotated in a direction, the cam pin 55 rotates and moves back and forth. Thus, the movable blade 42 perform back-and-forth reciprocating motions. When the cam pint is at the rearmost position thereof, the movable blade 42 is at the home position. When the cam pin 55 is at the frontmost position, the movable blade 42 reaches a cutting position at which the blade portion 42*a* of the front edge is superposed on the fixed blade 14.

The home position sensor 45 detects a state in which the movable blade 42 is at the home position. This sensor 45 is attached to the support plate 41. A tilting switch 45*a* is brought into contact with and pushed by the outer peripheral surface of the cam portion 52*a* of the worm wheel 52, so that the switch is ON. Further, when a notch 52*b* formed in the cam portion 52*a* reaches the switch 45*a*, the switch is OFF. During the worm wheel 52 rotates and the movable blade 42 is caused to perform reciprocating motions, the switch of the home position sensor 45 is ON. When the movable blade 42 is at the home position, the switch is OFF. Thus, this sensor detects the state of the movable blade 42.

The movable blade 42 is usually placed at the home position. When the body cover 20 is closed, the blade portion 42*a* of the movable blade 42 is a little away from the blade portion 14*a*of the fixed blade 14. The guide piece 42*c* of the movable blade 42 gets on both ends of the fixed blade 14. The leading end portion of the paper S accommodated in the paper accommodating portion 12 of the frame 11 is put between the thermal head 13 and the platen roller 30 when the body cover 20 is closed. Thus, this portion of the paper S passes through between the fixed blade 14 and the movable blade 42 and is then ejected from the paper exit between the body cover 20 and the fixed-blade cover 15. This path is a conveying path for conveying the paper S. The platen-roller 30 rotates in a direction of an arrow F shown in FIGS. 1 and 2, so that the paper S is conveyed on the conveying path by friction between the platen roller 30 and the thermal head 13. When the movable blade 42 goes toward the fixed blade 14, the blade portion 42*a* is superposed on the fixed blade 14 when moved toward the fixed blade 14. Thus, the blade portion 42*a* cuts the paper on the paper conveying path in cooperation with the fixed blade 14.

Further, although not shown, the frame 11 has a cover open-state sensor for detecting whether or not the body cover 20 is opened. Signals outputted from these sensors are supplied to the printer control portion, which controls the movable blade drive motor 45 so that the movable blade 42 performs reciprocating motions only when the body cover 20 is closed. Further, the printer control portion controls the movable blade drive motor 45 so that the movable blade 42 returns to the home position when the body cover 20 is opened and the movable blade 42 is not at the home position.

Next, the mounting structure for mounting the fixed-blade cover 15 onto the frame 11, and the engaging/disengaging mechanism for engaging the body cover 20 with and disengaging the body cover 20 from the printer body 10 are described hereinbelow.

As shown in FIGS. 1 and 2, a rotation shaft 17 extending laterally is spanned between the front end portions of the lateral side plates Ha in such a manner as to be rotatable therearound. Both ends of this rotation shaft outwardly project from the side plates 11*a*. The fixed blade cover 15 is constituted by integrally forming a cover portion 60, which actually covers the fixed blade 14 and has a nearly L-like section, and side plates 61*a* and 61*b*, which extend vertically downwardly from the lateral end portions of the cover portion 60, with one another. The side plates 61*a* and 61*b* are supported by both projecting end portions of the rotation shaft 17 in such a manner as to be able to relatively rotate in directions of arrows A and B of FIGS. 1 to 7. As is apparent from FIG. 5, a cover opening lever (cover opening means) 70 is disposed at the right side of the fixed blade cover 15. This cover opening lever 70 has a base end portion integrally engaged with the right-hand projecting end portion of the rotation shaft 17, and is enabled to turn in the directions of the arrows A and B. In the case of the cover opening lever 70, the direction of the arrow A is a direction in which the cover retreats, while the direction of the arrow B is a direction in which the cover is closed. A pin 62, which is adapted to engage with the cover opening lever 70 when the cover opening lever 70 is depressed and turned in the direction of the arrow A, is formed on the right-hand side plate 61*b* of the fixed blade cover 15 in such a manner as to outwardly project therefrom.

As illustrated in FIG. 2, an almost cross-like unlocking lever 80 is placed outside the left-hand side plate 61*a* of the fixed blade cover 15. This unlocking lever 80 is engaged with the left-hand projecting end portion of the rotation shaft 17 in such a way as to be integrally rotated with the rotation shaft 17. An outwardly projecting pin 63 is formed on a lower portion of the left-hand side plate 61*a* of the fixed blade cover 15. A lower convex portion 81, which engages with the pin 63 when turned in the direction of the arrow A, is formed on the unlocking lever 80.

L The fixed blade cover 15, the cover opening lever 70, and the unlocking lever 80 are enabled to rotate around the rotation shaft 17 in the directions of the arrows A and B in FIGS. 1 to 8. However, the fixed blade cover 15 can perform a relative turn with respect to the rotation shaft 17. The cover opening lever 70 and the unlocking lever 80 rotate together with the rotation shaft 17. That is, when the cover opening lever 70 is turned, the unlocking lever 80 is also turned together therewith.

As illustrated in FIGS. 1 and 2, an inwardly projecting stopper pin 64 is formed on the bottom portion of each of the side plates 61*a* and 61*b* of the fixed blade cover 15. Each of stopper pins 64 engages with a torsion spring 90 constituted by a helical torsion spring that is fitted into the concave portion 18 of the lateral side plates 11*a* of the frame 11. This torsion spring 90 pushes the fixed blade cover 15 so that this cover is turned in the direction of the arrow B at all times. When each of the stopper pins 64 engages with the front end part of the concave portion 18, the turn of the cover 15 in the direction of the arrow B is restricted.

Locking levers 65 and 66 are attached to the upper portions of the side plates 61*a* and 61*b* of the fixed blade cover 15 through the shafts 65A and 66A in such a manner as to be able to turn in the directions of the arrows A and B shown in FIGS. 1 to 8. As illustrated in FIG. 2, a torsion coil spring 91 attached to the shaft 65A pushes the left-hand locking lever 65 so that the locking lever 65 is turned in the direction of the arrow A at all times. The locking lever is adapted to stop at a position at which a claw 65*a* formed at the front portion of the locking lever 65 abuts against the upper convex portion 82 of the unlocking lever 80. On the other hand, as illustrated in FIG. 1, an extension spring 92 spanned between an arm 66*a* of the right-hand locking lever 66 and the projecting end of the rotation shaft 17 pushes the lock lever 66 to be turned in the direction of the arrow A at all times. However, the lock lever 66 is stopped at a position at which the arm 66*a* abuts against the cover opening lever 70. This cover opening lever 70 is pushed by the extension spring 92 in the direction of the arrow B through the arm 66. Hooks 65*b* and 66*b* for restricting the turn of the fixed blade cover 15 in the direction of the arrow A, which engages with the outwardly projecting pin 22 formed on the front end portion of the body cover 20 when the body cover 20 is closed, are formed on the rear portions of these locking levers 65 and 66.

As illustrated in FIG. 1, a return lever 71, which engages with and integrally rotates together with the cover opening lever 70 when the cover opening lever 70 is turned in the direction of the arrow A by a certain amount, is attached to the rotation shaft 17. This return lever 71 is pushed by an extension spring 93 at all times in such a manner as to rotate in the direction of the arrow B, and stopped at a position at which this lever abuts against the pin 19 provided on the right-hand side plate 11*a* of the frame 11.

As shown in FIG. 2, a stopper 85, which restricts the turn of the fixed blade cover 15 in the direction of the arrow A when the body cover 20 is opened, is provided on the left-hand side plate 11*a* of the frame 11. This stopper 85 is nearly L-shaped, and configured by projecting a stopper piece 87, which is perpendicular to a base portion 86 and extends forwardly, from the base portion 86, which slightly bends forwardly and extends upwardly or downwardly. This stopper 85 is supported by the side plate 11*a* by being pushed by two guide pins 88 engaged with the base portion 86 in such a way as to be able to slide in the directions of the arrows C and D, and by being pressed at all times in the direction of the arrow C by a compression spring 94 fitted into the side plate 11*a*.

As illustrated in FIG. 8, when the body cover 20 is opened, the end portion of the stopper piece 87 engages with the rear side of the convex portion 67 formed on the left-hand side plate 61*a* of the fixed blade cover 15, so that the stopper 85 restricts the turn of the fixed blade 15 in the direction of the arrow A. Further, as illustrated in FIG. 2, when the body cover 20 is closed, the top part of the base portion 86 abuts against the left-hand side plate 11*a*. Thus, the stopper 85 is depressed against the force of the compression spring 94. Thus, the engagement of the stopper piece 87 with the convex portion 67 of the fixed blade cover 15 is disengaged.

Next, an operation of opening the closed body cover 20 is described hereinbelow.

As illustrated in FIGS. 1 and 2, in a state in which the body cover 20 is closed, the upward turn of the body cover 20 is restrained by engaging the hook 21 with the hook 16 at the side of the fixed blade cover 15. Thus, the closed state of the body cover 20 is maintained. The fixed blade cover 15 is caused by the elastic repulsion force of the torsion spring 90 to abut against the body cover 20 by applying a certain pressure thereto, so that the turn of the cover 15 in the direction of the arrow B is restricted. The position of this cover is a little closer to the front of the printer body 20 than the position at which the pin 64 engages with the front end part of the concave portion 18 and is closest to the body cover 20. Further, the hook 65*b* of the left-hand locking lever 65 and the hook 66*b* of the right-hand locking lever 66 engage with the pins 22 of the body cover 20. Thus, the fixed blade cover 15 is restrained from turning in the direction of the arrow A, in which this cover goes away from the body cover 20. That is, the fixed blade cover 15 is locked at the position in a state in which the body cover 20 is closed. This locking of the cover 15 is achieved by the body cover 20 and the locking levers 65 and 66. In this embodiment, the locking mechanism for locking the fixed blade cover 15 at the position, which is opposite to the body cover 20, is composed of the body cover 20 and the locking levers 65 and 66. When the body cover 20 is closed, the movable blade 42 faces the fixed blade 14 across the paper conveying path. Moreover, the guide pieces 42*c* provided at both end portions thereof get on the fixed blade 14.

To open the body cover 20, the cover opening lever 70 is depressed and turned in the direction of the arrow A. As illustrated in FIG. 3, when the cover opening lever 70 is depressed by an amount corresponding to one step, the right-hand locking lever 66 is turned in the direction of the arrow B by the cover opening lever 70 through the arm 66*a*. Thus, the engagement of the hook 66*b* with the pin 22 of the body cover 20 is disengaged. On the other hand, as illustrated in FIG. 4, when the cover opening lever 70 is depressed by an amount corresponding to one step, the unlocking lever 80 turns in the direction of the arrow A together with the rotation shaft 17. Then, the upper convex portion 82 pushes the claw 65*a*, so that the left-hand locking lever 65 is turned in the direction of the arrow B. Simultaneously, the hook 65*b* of the locking lever 65 is disengaged from the pin 22. This enables the fixed blade cover 15 to turn in the direction of the arrow A.

When the cover opening lever 70 is depressed still more against the elastic force of the torsion spring 90, the cover opening lever 70 engages with the pin 62 of the fixed glade cover 15, as illustrated in FIG. 5. On the other hand, as illustrated in FIG. 6, the lower convex portion 81 of the unlocking lever 80 engages with the pin 63 of the fixed blade cover 15. Thus, the fixed blade cover 15 turns in the direction of the arrow A by being simultaneously depressed. Halfway through this turn, the hook 16 of the fixed blade cover 15 is disengaged from the hook 21 of the body cover 20. Thus, the body cover 20 can be opened. When the engagement between the hooks 16 and 21 is disengaged, the body cover 20 is lifted by the stopper 85 by the elastic repulsion force of the compression spring 94, which pushes the stopper 85. An opening operation is assisted in this manner.

When the body cover 20 is opened, the cover opening lever 70 is released. Then, as illustrated in FIG. 7, the cover opening lever 70 is returned to the home position thereof by the extension spring 93. Moreover, the fixed blade cover 15 is turned to the side of the body cover 20 until the pin 64 is placed at the front end of the concave portion 18. Then, the fixed blade cover 15 stops. At this position, the cover portion 60 of the fixed blade cover 15 covers over the fixed blade 14. In a state in which the fixed blade cover 15 covers the fixed blade in this way, as illustrated in FIG. 8, the stopper piece 87 of the stopper 85 engages with the convex portion 67 of the left-hand side plate 61*a*, so that the turn of the fixed blade cover 15 in the direction of the arrow A is restricted. Furthermore, the engagement of the stopper pin 64 with the front end of the concave portion 18 restricts the turn of the fixed blade cover 15 in the direction of the arrow B. That is, the fixed blade cover 15 is locked in a state in which the body cover 20 is opened and in which the cover 15 covers the fixed blade 14. In this embodiment, the locking mechanism for locking the fixed blade cover 15 at the position, at which the fixed blade is covered, is composed of the stopper pin 64 and the stopper 85.

The body cover 20 is opened in the aforementioned manner when new paper is accommodated in the paper accommodating portion 12, or when printer maintenance is performed. Upon completion of such operations, the body cover 20 is closed again. Halfway through the closing of the body cover 20, the fixed blade cover 15 is once retreated in the direction of the arrow A by being pressed by the hook 21 of the body cover 20. Thereafter, the fixed blade cover 15 is turned to the side of the body cover 20 by the elastic repulsion force of the torsion spring 90. Thus, the hooks 16 and 21 engage with each other. The printer returns to the closed state illustrated in FIGS. 1 and 2.

B. Fundamental Operation of Printer

Next, the fundamental operation of the printer is described hereinbelow.

First, the body cover 20 is opened. Then, a leading end portion of the paper S is drawn out of a paper exit between the printer body 10 and the body cover 20. Subsequently, the body cover 20 is closed and put into a set state. When a printing instruction is supplied from a host system to the printer control portion, data is printed on the paper S by the thermal head 13. The printing is performed according to print data by repeating a 1-line printing operation and an operation of feeding paper of 1 line by the platen roller. Upon completion of printing a predetermined amount of data, the platen roller feeds the printed paper S, which is then ejected from the paper exit. Subsequently, the movable-blade drive motor 51 is activated, so that the movable blade 42 performs one reciprocating motion. During this reciprocating motion, the paper S is cut. A single reciprocating motion of the movable blade 42 is caused by one revolution of the worm wheel 52. When the home position sensor 45 is turned on and then turned off, it is determined that the movable blade 42 has performed one reciprocating motion. Then, the movable-blade drive motor 51 is stopped.

C. Paper Jam Clearance

In the case that a paper jam, by which the paper S is put between both the fixed blade 14 and the movable blade 42, occurs when the paper S is cut (or when the movable blade 42 moves toward or back from the fixed blade 14), the paper jam can be cleared by opening the body cover 20 having the movable blade 42. That is, the movable blade 42 is superposed on the fixed blade 14 when moved toward the fixed blade. This prevents the movable blade 42 from abutting against the fixed blade 14 when the body cover 20 is opened, and from hindering an opening operation of the body cover 20. Consequently, a paper jam clearing operation can quickly be performed by opening the body cover 20 and removing a jammed part of the paper S. Incidentally, when a paper jam occurs, the movable blade 42 is locked and put into a state in which the movable blade 42 does not return to a home position. However, when the body cover 20 is opened, the printer control portion determines that the body cover 20 is opened and that the movable blade 42 is not returned to the home position. Then, the movable-blade drive motor 51 is activated, so that the movable blade 42 is returned to the home position.

Further, the paper S having passed through the cutting portion is not under tension but -is in a free state. In contrast, the paper S placed on a portion at the upstream side of the cutting portion is under tension when the paper S is cut. Incidentally, in this embodiment, the paper S is fixed under tension at the side of the fixed blade 14 by superposing the movable blade 42 on the downstream-side portion of the fixed blade 14. Conversely, the paper is in a free state at the side of the movable blade 42. Thus, the paper is cut well. Consequently, there is no fear that a cut sheet is damaged. In contrast with this embodiment, in the case of employing the configuration in which the movable blade 42 is superposed on the upstream-side portion of the fixed blade 14, the paper S held under tension may interfere with the movable blade 42. Further, the paper S on a portion at the side of the fixed blade 14 may be insecurely fixed thereto. Thus, the movement of the movable blade 42 may cause the paper S, which is placed at the side of the fixed blade 14, to move. Consequently, the cutter mechanism employing this configuration is relatively inferior in the degree how well it cuts the paper. Moreover, the movable blade 42 may damage and streak the paper S.

D. Operation of Fixed Blade Cover

In this embodiment, when the body cover 20 is in an opened state, the fixed blade cover 15 covers over the fixed blade 14. Further, the position of the fixed-blade cover 15 is locked as above described. This prevents the fixed blade 14 from being touched in a state in which the body cover 20 is opened. This is an effective safety measure, because the fixed blade cover 15 does not move and thus safety is assured, especially, even in the case that a user's hand touches the fixed blade cover 15 when the paper S is accommodated in the paper accommodating portion 12. Moreover, even when the body cover 20 is in a closed state, the fixed blade cover 15 is locked. This prevents an occurrence of the problem that the body cover 20 accidentally opens to thereby cause a malfunction of the printer.

Further, this embodiment is adapted so that when the cover opening lever 70 is depressed, the fixed blade cover 15 operates together therewith and retreats the rotating end portion of the body cover 20. Thus, the body cover 20 can smoothly be opened by performing a single operation.

As described above, according to the present invention, the printer is adapted so that the movable blade is superposed on the fixed blade when moved toward the fixed blade. Thus, the body cover can be opened without being damaged by the fixed blade. Consequently, the printer has advantageous effects in that a user can quickly perform an operation of opening the body cover and clearing a paper jam, and that paper can be cut well.

What is claimed is:

1. A printer comprising:

a printer body having a paper accommodating portion, a paper conveying path, and a printing mechanism for printing data on paper conveyed on said paper conveying path;

a body cover rotatably and disengageably attached to said printer body in such a manner as to close said paper accommodating portion; and a paper cutter mechanism for cutting paper on said paper conveying path at a downstream side of said printing mechanism;

wherein said paper cutter mechanism comprises:

a plate-shaped fixed blade provided in said printer body;

a plate-shaped movable blade provided on said body cover so as to face said fixed blade across said paper conveying path when said body cover is closed, and to be able to perform reciprocating motions with respect to said fixed blade, and to cut paper in cooperation with said fixed blade by being superposed on said fixed blade when moved toward said fixed blade; and drive means for causing said movable blade to perform reciprocating motions;

wherein, when said movable blade is superposed on said fixed blade, said movable blade is positioned more downstream than said fixed blade on the paper conveying path and in a position not to interfere with said fixed blade when the body cover is opened; and a fixed-blade cover provided in said printer body so as to face a rotating end portion of said body cover, when the cover is closed, and to cover a blade portion of said fixed blade when said body cover is opened, wherein said fixed blade cover is enabled to retreat from said rotating end portion of said body cover in such a way as to allow a disengaging motion of said body cover with respect to said printer body.

2. The printer according to claim 1, further comprising a locking mechanism for locking said fixed-blade cover at a position, at which said fixed-blade cover covers said fixed blade, and at a predetermined position that is opposite to said rotating end portion of said body cover.

3. The printer according to claim 2, further comprising cover opening means provided in said printer body for enabling said body cover to open by canceling an engaged state where said body cover engages with said printer body;

wherein when said cover opening means is operated, said fixed blade cover operates together therewith and retreats from said rotating end portion of said body cover.

4. The printer according to claim 1, further comprising cover opening means provided in said printer body for enabling said body cover to open by canceling an engaged state where said body cover engages with said printer body;

wherein when said cover opening means is operated, said fixed blade cover operates together therewith and retreats from said rotating end portion of said body cover.

* * * * *